US011283181B2

(12) United States Patent
Wu et al.

(10) Patent No.: US 11,283,181 B2
(45) Date of Patent: Mar. 22, 2022

(54) ANTENNA MODULE

(71) Applicant: PEGATRON CORPORATION, Taipei (TW)

(72) Inventors: Chien-Yi Wu, Taipei (TW); Chao-Hsu Wu, Taipei (TW); Ching-Hsiang Ko, Taipei (TW); Cheng-Hsiung Wu, Taipei (TW); Shih-Keng Huang, Taipei (TW); Yi-Ru Yang, Taipei (TW); Sheng-Chin Hsu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/035,435

(22) Filed: Sep. 28, 2020

(65) Prior Publication Data

US 2021/0159602 A1 May 27, 2021

(30) Foreign Application Priority Data

Nov. 25, 2019 (TW) ..... 108142812

(51) Int. Cl.
*H01Q 1/24* (2006.01)
*H01Q 13/10* (2006.01)
*H01Q 13/16* (2006.01)

(52) U.S. Cl.
CPC ..... *H01Q 13/16* (2013.01); *H01Q 13/103* (2013.01)

(58) Field of Classification Search
CPC ..... H01Q 13/103; H01Q 13/10; H01Q 13/16; H01Q 5/36; H01Q 5/364; H01Q 1/24; H01Q 1/38; H01Q 5/10
See application file for complete search history.

(56) References Cited

U.S. PATENT DOCUMENTS

| | | | | |
|---|---|---|---|---|
| 8,854,267 | B2 * | 10/2014 | Kim | H01Q 5/378 343/702 |
| 9,190,713 | B2 * | 11/2015 | Eom | H01Q 1/243 |
| 9,343,802 | B2 * | 5/2016 | Su | H01Q 1/243 |
| 10,186,755 | B2 * | 1/2019 | Xiong | H01Q 5/50 |
| 10,700,409 | B2 * | 6/2020 | Huang | H01Q 1/2266 |
| 10,720,695 | B2 * | 7/2020 | Yu | H01Q 21/28 |
| 10,931,008 | B2 * | 2/2021 | Qiu | H01Q 1/243 |
| 10,944,151 | B2 * | 3/2021 | Hsu | H01Q 5/378 |

FOREIGN PATENT DOCUMENTS

| | | |
|---|---|---|
| TW | 201113665 | 4/2011 |
| TW | I652853 | 3/2019 |
| TW | 201941490 | 10/2019 |

* cited by examiner

*Primary Examiner* — Tho G Phan
(74) *Attorney, Agent, or Firm* — J.C. Patents

(57) ABSTRACT

An antenna module includes a metal frame and an antenna structure. The metal frame includes an opening and a first edge and a second edge located at two opposite sides of the opening. The antenna structure is disposed at the opening and includes a first radiator, a second radiator, a first conductor, and a second conductor. The first radiator includes first and second sections. The first section is near the first edge and includes a feeding end, and the second section extends from the first section to the second edge. The second radiator is located between the first section and the first edge and includes a ground end. A first slit is formed between the second radiator and the first section. The first conductor is connected between the second radiator and the metal frame. The second conductor is connected between the second radiator and the metal frame.

10 Claims, 9 Drawing Sheets

ANTENNA MODULE

CROSS-REFERENCE TO RELATED APPLICATION

This application claims the priority benefit of Taiwan application no. 108142812, filed on Nov. 25, 2019. The entirety of the above-mentioned patent application is hereby incorporated by reference and made a part of this specification.

BACKGROUND

Technical Field

The disclosure relates to an antenna module, and in particular, to a multi-band antenna module.

Description of Related Art

At present, in the fifth generation (5G) mobile communication, a Sub 6G LTE MIMO antenna is required to cover more and more frequency bands, including not only an original frequency band of 1710 MHz to 2700 MHz but also frequency bands n77-n79 (3300 MHz to 5000 MHz) and frequency bands LAA B252 and B255 (5150 MHz to 5850 MHz).

SUMMARY

The disclosure provides an antenna module for generating a plurality of frequency bands through coupling.

An embodiment of the disclosure provides an antenna module which includes a metal frame and an antenna structure. The metal frame has an opening, and the metal frame has a first edge and a second edge located at two opposite sides of the opening. The antenna structure is disposed at the opening and includes a first radiator, a second radiator, a first conductor, and a second conductor. The first radiator is disposed at the opening and includes a first section and a second section. The first section is near the first edge and includes a feeding end, and a second section extends from the first section to the second edge. The second radiator is disposed at the opening and located between the first section and the first edge, and the second radiator includes a ground end. A first slit is formed between the second radiator and the first section. The first conductor is connected between the second radiator and the metal frame. The second conductor is connected between the second radiator and the metal frame.

In view of the above, owing to the arrangement of the metal frame, the first radiator, the second radiator, the first conductor, and the second conductor of the antenna module provided in one or more embodiments of the disclosure, multiple frequency bands may be generated through coupling, so as to comply with broadband requirements.

Several exemplary embodiments accompanied with figures are described in detail below to further describe the disclosure in details.

BRIEF DESCRIPTION OF THE DRAWINGS

Reference will now be made in detail to the embodiments of the disclosure, examples of which are illustrated in the accompanying drawings. Wherever possible, the same reference numbers are used in the drawings and the description to refer to the same or like parts.

DESCRIPTION OF THE EMBODIMENTS

Figure 1:
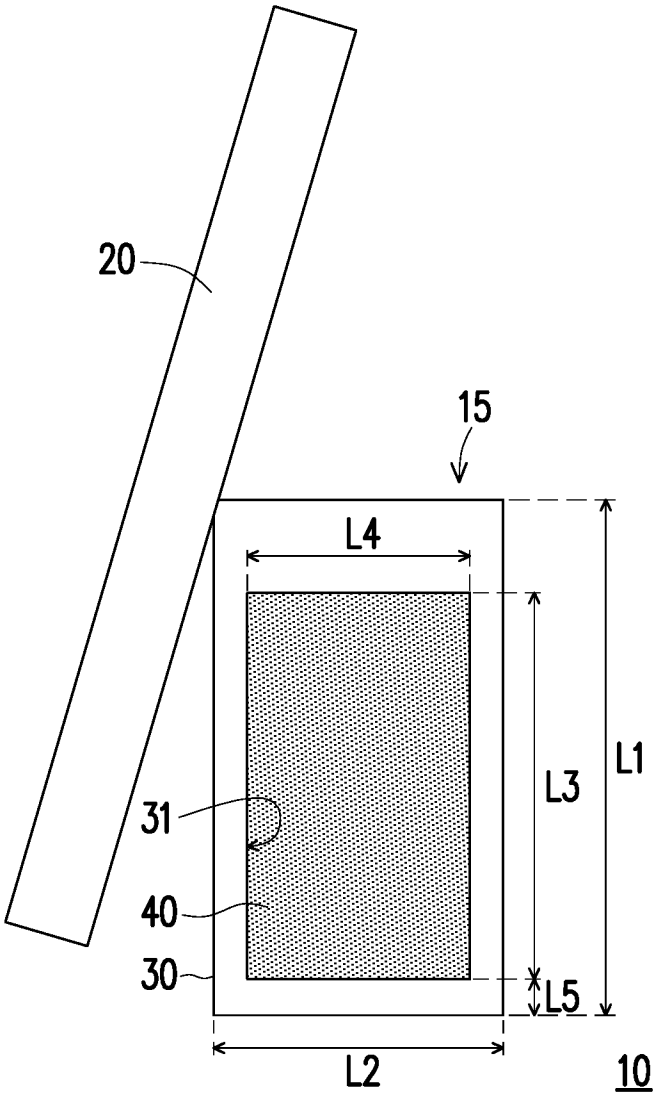
FIG. 1 is a schematic side view of an appearance of an electronic device according to an embodiment of the disclosure.
Figure 2:
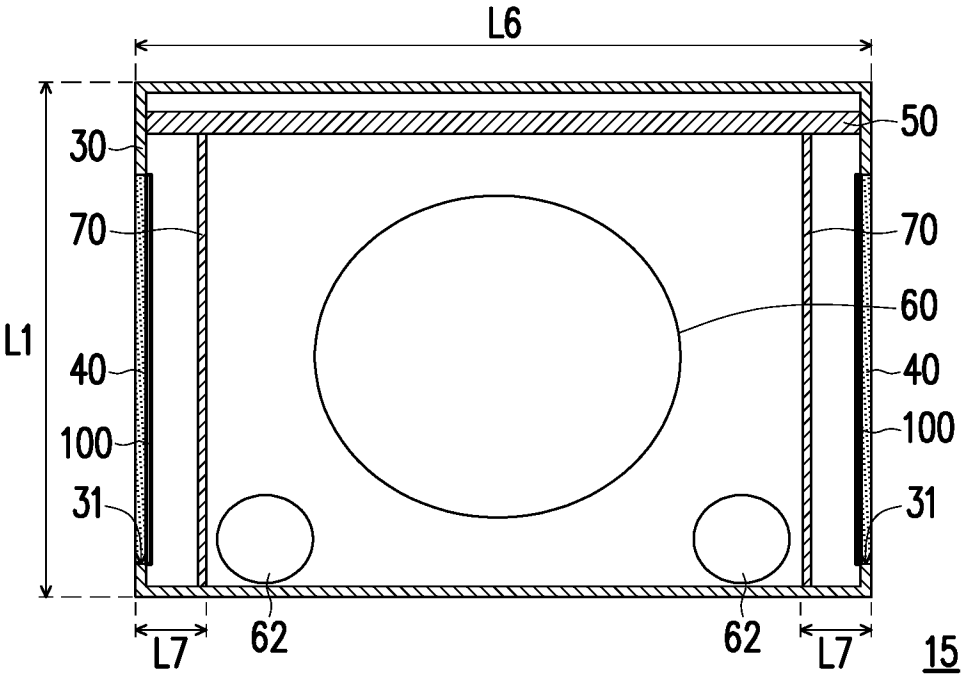
FIG. 2 is a schematic cross-sectional view of a first body of the electronic device in FIG. 1.

FIG. 1 is a schematic side view of an appearance of an electronic device according to an embodiment of the disclosure. FIG. 2 is a schematic cross-sectional view of a first body of the electronic device in FIG. 1. FIG. 2 is, for example, a view of a hidden second body seen from a right side to a left side of FIG. 1. Referring to FIG. 1 and FIG. 2, an electronic device 10 of the present embodiment is, for example, a smart speaker device, but a type of the electronic device 10 is not limited thereto. In the present embodiment, the electronic device 10 includes a first body 15 and a second body 20. The first body 15 is, for example, a main body (speaker cavity), and the second body 20 is, for example, a display.

In the present embodiment, the first body 15 includes a metal frame 30, such as a housing. For example, the metal frame 30 has a height L1 of 120 mm, a width L2 of 47 mm, and a length L6 (FIG. 2) of 240 mm, but dimensions of the metal frame 30 are not limited thereto. As shown in FIG. 2, a main board 50, a low-frequency speaker cavity 60, and at least one (for example, two) high-frequency speaker cavity 62 is disposed in the metal frame 30.

The metal frame 30 includes at least one opening 31. As shown in FIG. 1, a length L3 of the opening 31 is, for example, 60 mm, and a width L4 of the opening 31 is, for example, 30 mm. A distance L5 between a bottom edge of the opening 31 and a bottom surface of the metal frame 30 is, for example, 5 mm, but a size of the opening 31 is not limited thereto.

In the present embodiment, the antenna module further includes at least one insulating member 40 filling the at least one opening 31. The insulating member 40 forms a plastic window region on the metal frame 30. At least one antenna structure 100 is disposed on the at least one insulating member 40.

As can be seen from FIG. 2, in the present embodiment, the metal frame 30 includes two opposite wall surfaces (a left wall surface and a right wall surface of FIG. 2). The at least one opening 31 of the metal frame 30 includes two openings 31, and the two openings 31 are located on the two wall surfaces. The at least one insulating member 40 includes two insulating members 40 disposed at the two openings 31 respectively. The at least one antenna structure 100 includes two antenna structures 100, but the disclosure is not limited thereto. In the present embodiment, the two antenna structures 100 are disposed on inner surfaces of the two insulating members 40 located in the two openings 31, respectively. In other words, the two antenna structures 100 are located on the inner surfaces on a left side and a right side of the metal frame 30 of the first body 15 respectively.

In the present embodiment, the antenna structure 100 may be, for example, a copper foil formed on a plastic substrate or a circuit formed on a circuit board. Alternatively, the antenna structure 100 may further be sprayed on plastic parts by LDS, but a method for forming the antenna structure 100 is not limited thereto. The antenna structure 100 is described below.

Figure 3:
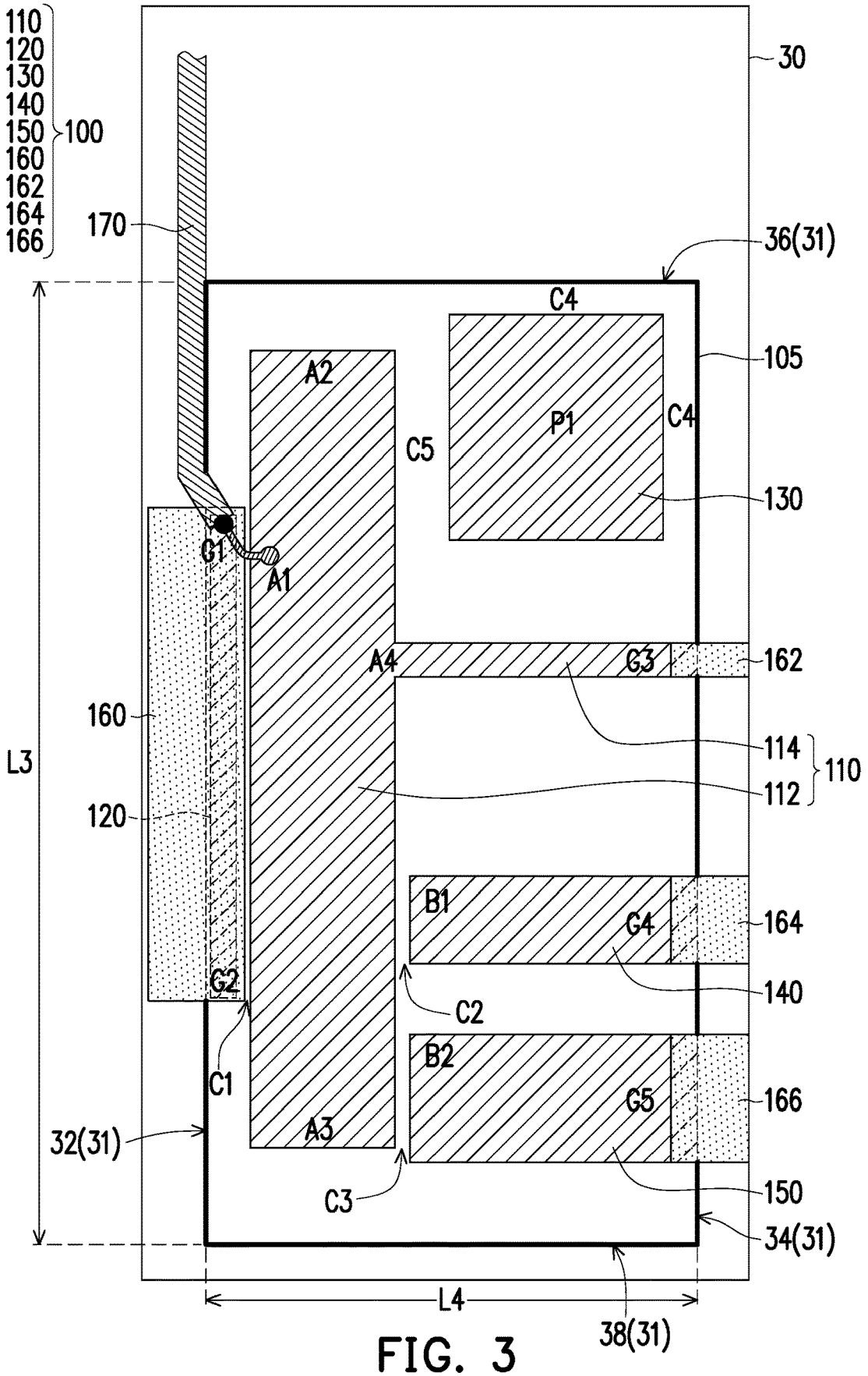
FIG. 3 is a schematic diagram of one of inner surfaces of the first body of the electronic device in FIG. 1.

FIG. 3 is a schematic diagram of one of inner surfaces of the first body of the electronic device in FIG. 1. Referring to FIG. 3, in the present embodiment, the antenna structure 100 may be disposed on a substrate 105 and at least includes a first radiator 110, a second radiator 120, a first conductor 160, and a second conductor 162. The first radiator 110 is disposed at the opening 31 and includes a first section 112 and a second section 114. The first section 112 includes a feeding end (position A1). The substrate 105 may be a flexible circuit board or a plastic substrate.

The opening 31 of the metal frame 30 includes a first edge 32 and a second edge 34 opposite to each other. The first section 112 extends along a direction of the first edge 32 and is arranged near the first edge 32, and the second section 114 extends from the first section 112 to the second edge 34. Shapes of the first section 112 and the second section 114 are similar to a T shape, but the shapes are not limited thereto. In particular, the first section 112 includes a first sub-region (positions A1, A2) and a second sub-region (positions A1, A3) connected to each other. The second section 114 (positions A4, G3) is connected to a junction between the first sub-region (positions A1, A2) and the second sub-region (positions A1, A3).

The second radiator 120 is disposed at the opening 31 and is located between the first section 112 and the first edge 32. It should be noted that, in the present embodiment, the second radiator 120 is covered by the first conductor 160 and located below the first conductor 160. The first conductor 160 is represented in FIG. 3 by slash lines below the first conductor 160. The second radiator 120 includes a ground end.

In the present embodiment, the feeding end (position A1) may be connected to a positive signal end of a coaxial transmission line 170, and the ground end (position G1) may be connected to a negative signal end of the coaxial transmission line 170. The coaxial transmission line 170 may be connected to a main board 50 of FIG. 2. The coaxial transmission line 170 is, for example, a low-loss line with an outer diameter of 1.13 mm and a length of 250 mm, but is not limited thereto.

In addition, in the present embodiment, the first conductor 160 is connected between the second radiator 120 and the metal frame 30 at a position close the first edge 32. Therefore, the ground end (position G1) of the second radiator 120 and the metal frame 30 (a system ground plane) may be conducted with each other through the first conductor 160. In addition, the second conductor 162 is connected between the second section 114 and the metal frame 30 at a position close to a corresponding second edge 34.

In the present embodiment, the antenna structure 100 is adapted for generating a first frequency band, a second frequency band, and a third frequency band through coupling. In particular, the antenna structure 100 is, for example, a Sub 6G LTE MIMO antenna. The first frequency band is from 1710 MHz to 2700 MHz, the second frequency band is from 3300 MHz to 5000 MHz, and the third frequency band is from 5150 MHz to 5850 MHz. Definitely, a type of the antenna structure 100 and a frequency band of coupling thereof are not limited thereto.

In particular, in the present embodiment, the opening 31 of the metal frame 30 sequentially includes a first edge 32 (left edge), a third edge 36 (upper edge), a second edge 34 (right edge), and a fourth edge 38 (lower edge). In the present embodiment, the first sub-region (positions A1, A2), the second section 114 (positions A4, G3), the second conductor 162, a part of the second edge 34 (an upper half of the right edge), a third edge 36, a part of the first edge 32 (an upper half of the left edge), the ground end, and the feeding end constitute a first closed loop, so that the first frequency band and the second frequency band are generated through coupling. In the present embodiment, a resonance path of the first closed loop is about 135 mm (that is, a full wavelength length of 2.2 GHz to 2.3 GHz), and two frequency bands of 2.25 GHz and a double frequency 4.5 GHz are generated through resonance.

In addition, in the present embodiment, the second sub-region (positions A1, A3), the second section 114 (positions A4, G3), the second conductor 162, the other part of the second edge 34 (lower half of the right edge), a fourth edge 38, the other part of the first edge 32 (a lower half of the left edge), the ground end, and the feeding end constitute a second closed loop, so that the first frequency band, the second frequency band, and the third frequency band are generated through coupling. In the present embodiment, a resonance path of the second closed loop is about 202 mm (that is, a full wavelength length of 1.5 GHz), and four frequency bands of 1.5 GHz, a double frequency 3 GHz, a triple frequency 4.5 GHz, and a quadruple frequency 6 GHz are generated through resonance.

In addition, a first slot C1 is formed between the second radiator 120 (a path formed by the positions G1, G2) and the first section 112 of the first radiator 110 (a path formed by the positions A2, A1, A3). A width of the first slot C1 is, for example, 0.5 mm, but the width of the first slot C1 is not limited thereto.

In the present embodiment, the second radiator 120 (a path formed by the positions G1, G2) is coupled to the first section 112 (a path formed by the positions A2, A1, A3) of the first radiator 110 to generate a WiFi 5 GHz frequency band through resonance. In addition, it may be further designed that a position of a WiFi 5 GHz frequency point is controlled by controlling a length of the first slot C1 and a length of the second radiator 120.

In addition, in the present embodiment, the antenna structure 100 further includes a third radiator 130 (position P1) located in the opening 31 and located among the second edge 34, the third edge 36, a first sub-section (positions A1, A2) of the first section 112, and the second section 114 (positions A4 and G3). An L-shaped second slot C4 is formed among the third radiator 130, the second edge 34, and the third edge 36. A fifth slot C5 is located between the third radiator 130 and the first sub-section (positions A1, A2) of the first section 112. The foregoing configuration may be used to adjust a position of the 3.5 GHz frequency point and improve impedance matching thereof.

In the present embodiment, the antenna structure 100 further includes a fourth radiator 140 and a third conductor 164. The fourth radiator 140 is located in the opening 31 and extends from a side of the first section 112 to the second edge 34. A third slot C2 is formed between the fourth radiator 140 and the first section 112. The third conductor 164 is connected between the fourth radiator 140 and the metal frame 30 at a position close to the second edge 34.

In addition, the antenna structure 100 further includes a fifth radiator 150 and a fourth conductor 166. The fifth radiator 150 is located in the opening 31 and extends from the first section 112 to the second edge 34. A fourth slot C3 is formed between the fifth radiator 150 and the first section 112. The fourth conductor 166 is connected between the fifth radiator 150 and the metal frame 30 at a position close to the second edge 34. In the present embodiment, the fourth radiator 140 is disposed parallel with the fifth radiator 150.

In the present embodiment, for the antenna structure 100, the fourth radiator 140 and the fifth radiator 150 are disposed within the second closed loop, so that a path formed by positions B1 and G4 and a path formed by positions B2 and G5 may be increased. A third slot C2 between the fourth radiator 140 and the second section 114 of the first radiator 110 and the fourth slot C3 between the fifth radiator 150 and the second section 114 of the first radiator 110 may be configured to adjust impedance matching with a frequency band of 1.7 GHz to 2.7 GHz.

Therefore, in the present embodiment, the antenna module including the antenna structure 100 and the edge of the opening 31 of the metal frame 30 through combination may cover a plurality of frequency bands of a Sub 6G LTE MIMO broadband antenna.

In addition, the antenna module may further be equipped with an antenna-multiplexer-circuit (not shown), so that an antenna can be shared for an LTE antenna and a WiFi antenna to make appropriate switching adjustment, a use space for the antenna may be reduced, and an application of an LTE MIMO multi-antenna is achieved. In particular, the antenna module of the present embodiment may be equipped with a low-pass filter (LPF), a band-pass filter (BPF), and/or a high-pass filter (HPF), and other different filters, to select to switch circuit integration and adjustment, so that antennas in a same frequency band are shared for the antenna module, reducing a number of the antennas.

Figure 4:
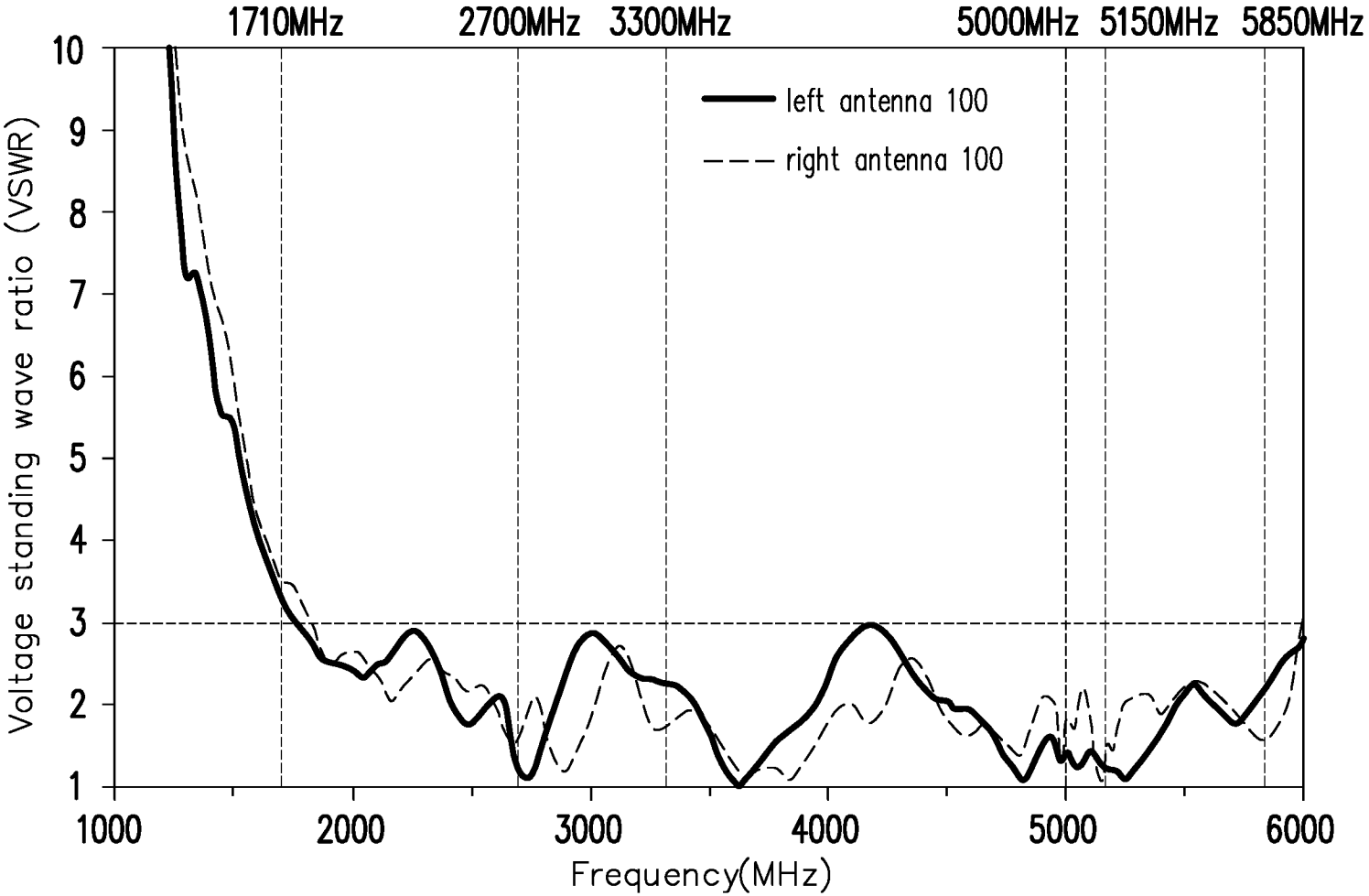
FIG. 4 is a relationship diagram of a frequency-voltage standing wave ratio of the electronic device in FIG. 1.

FIG. 4 is a relationship diagram of a frequency-voltage standing wave ratio of the electronic device in FIG. 1. Referring to FIG. 4, in the present embodiment, voltage standing wave ratios (VSWR) of two antenna structures 100 located on a left side and a right side of FIG. 2 may be below 3 in a first frequency band (1710 MHz to 2700 MHz), a second frequency band (3300 MHz to 5000 MHz), and a third frequency band (5150 MHz to 5850 MHz), to achieve good performance.

Figure 5:
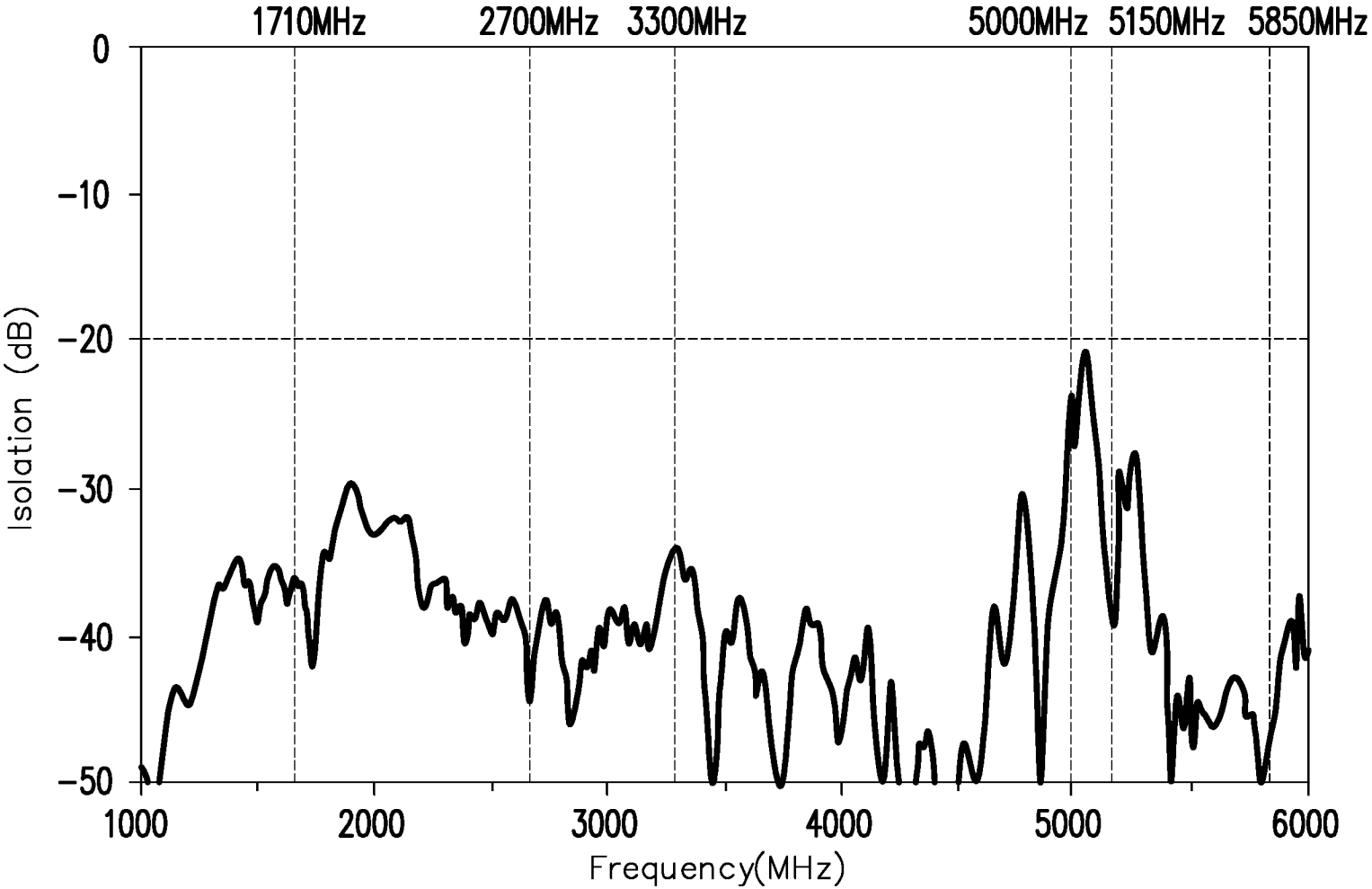
FIG. 5 is a relationship diagram of a frequency-isolation of the electronic device in FIG. 1.

FIG. 5 is a relationship diagram of a frequency-isolation of the electronic device in FIG. 1. Referring to FIG. 2 and FIG. 5, in the present embodiment, the antenna module further includes at least one metal stopper wall 70 disposed in the metal frame 30 and between the two antenna structures 100. More particular, the antenna module includes two metal stopper walls 70 disposed beside the two antenna structures 100. The metal stopper walls 70 are configured to block a low-frequency speaker cavity 60, a high-frequency speaker cavity 62, and a speaker sound source line (not shown) that are made of metal from generating an unnecessary resonance mode of the antenna structure 100. In the present embodiment, a distance L7 between the metal stopper wall 70 and the antenna structure 100 is, for example, 20 mm, but is not limited thereto. As can be seen from FIG. 5, in the present embodiment, isolation between the two antenna structures 100 may be less than −20 dB, and has good performance.

Figure 6:
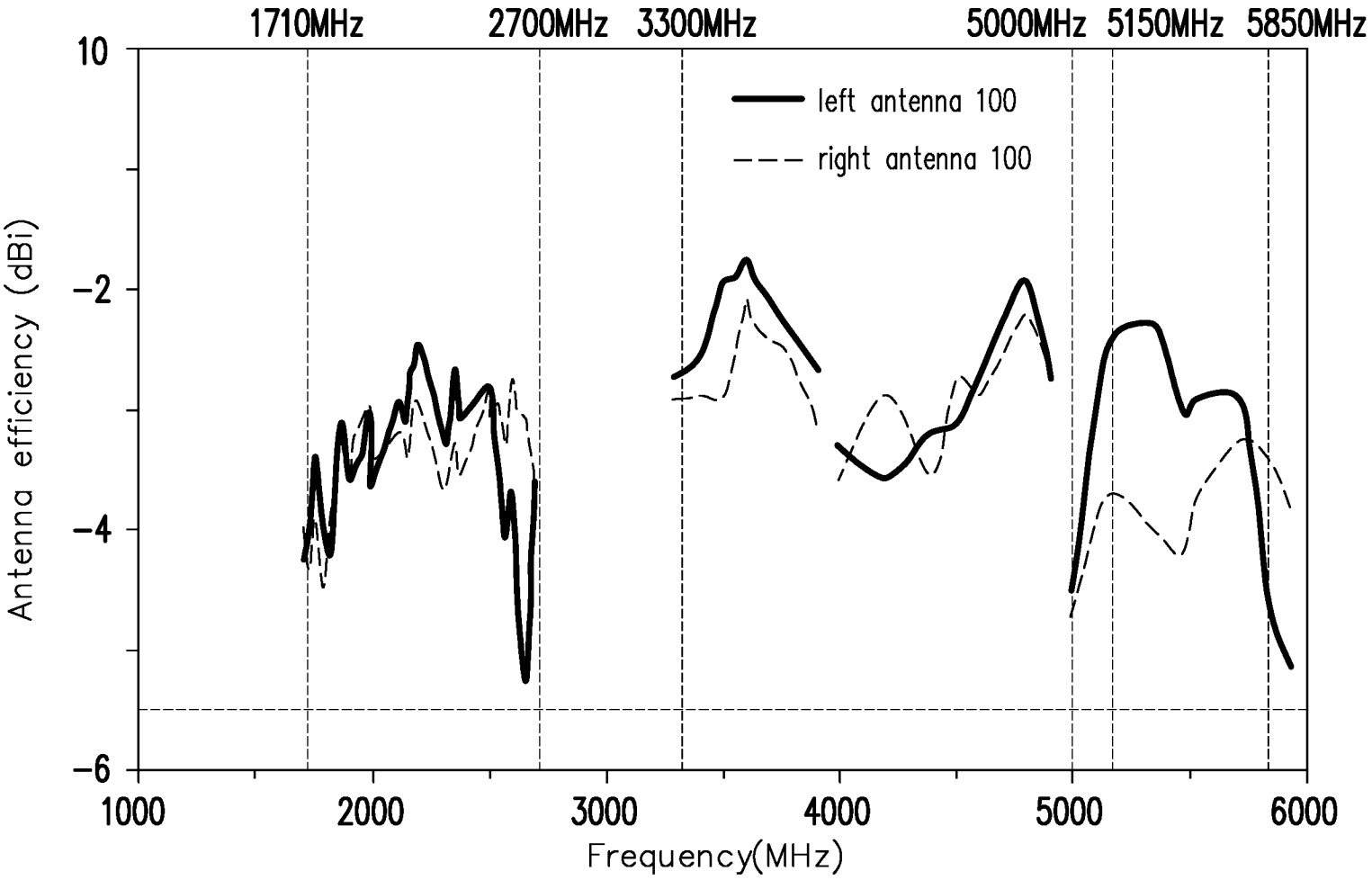
FIG. 6 is a relationship diagram of frequency-antenna efficiency of the electronic device in FIG. 1.

FIG. 6 is a relationship diagram of frequency-antenna efficiency of the electronic device in FIG. 1. Referring to FIG. 6, in the present embodiment, two antenna structures 100 located on the left side and the right side of FIG. 2 have antenna efficiency of −2.5 dBi to −5.2 dBi in a first frequency band (1710 MHz to 2700 MHz), antenna efficiency of −1.8 dBi to 3.5 dBi in a second frequency band (3300 MHz to 5000 MHz), and antenna efficiency of −2.3 dBi to −5.1 dBi in a third frequency band (5150 MHz to 5850 MHz), the antenna efficiency of the two antenna structures 100 may be greater than −5.5 dBi, so that the two antenna structures have a wideband antenna efficiency performance.

Figure 7:
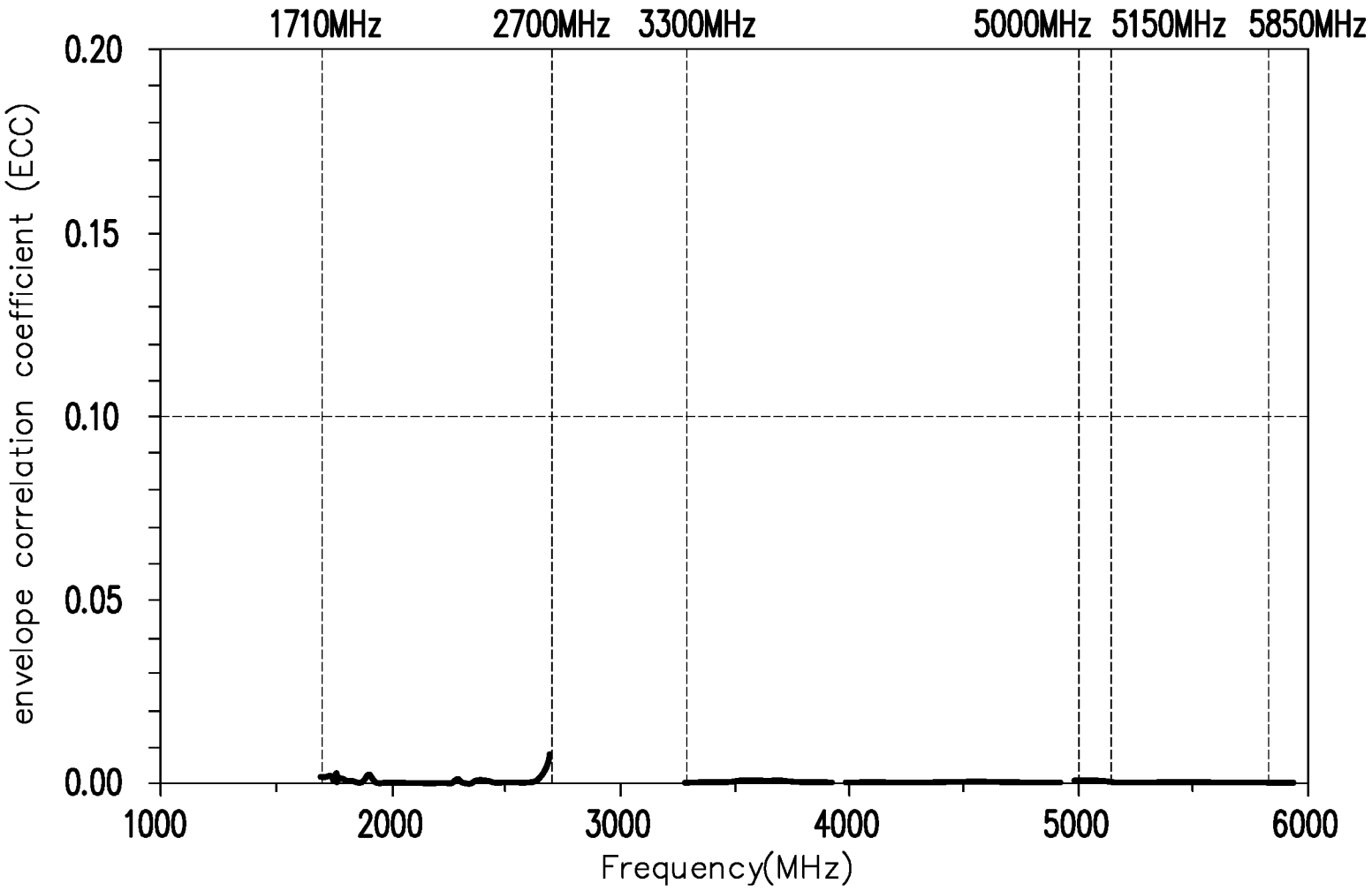
FIG. 7 is a relationship diagram of a frequency-encapsulation correlation coefficient of the electronic device in FIG. 1.

FIG. 7 is a relationship diagram of a frequency-envelope correlation coefficient of the electronic device in FIG. 1. Referring to FIG. 7, in the present embodiment, an envelope correlation coefficient ECC between the two antenna structures 100 may be less than 0.1, and has a good performance.

Figure 8:
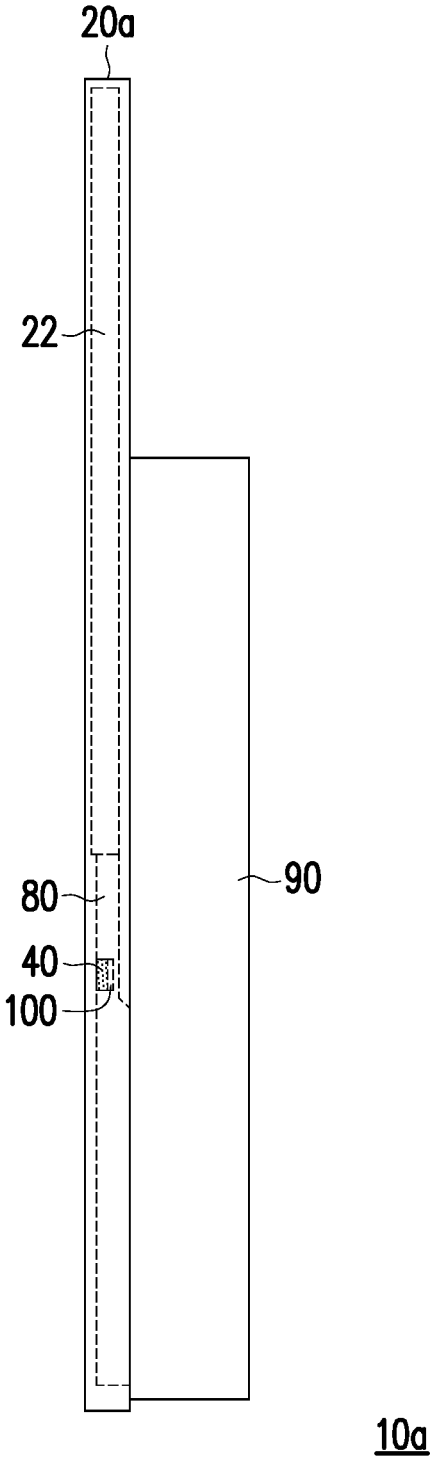
FIG. 8 is a schematic side view of an appearance of an electronic device according to another embodiment of the disclosure.
Figure 9:
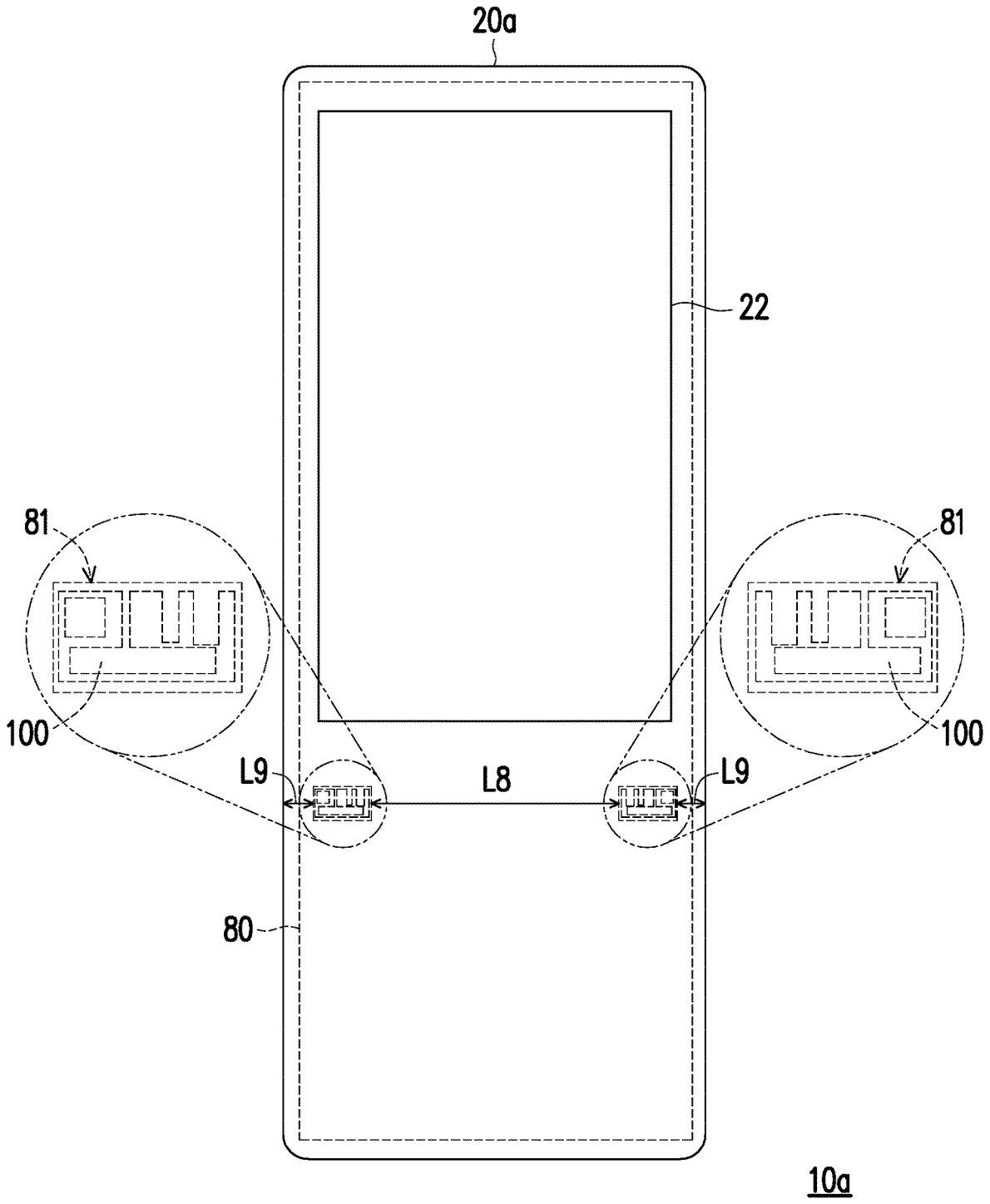
FIG. 9 is a schematic front view of the electronic device in FIG. 8.

FIG. 8 is a schematic side view of an appearance of an electronic device according to another embodiment of the disclosure. FIG. 9 is a schematic front view of the electronic device in FIG. 8. Referring to FIG. 8 and FIG. 9, in the present embodiment, for example, an electronic device 10*a* is a smart mirror device, including a first body 90 and a second body 20*a*. The second body 20*a* includes a display screen 22 and a metal frame 80. As shown in FIG. 9, in the present embodiment, the metal frame 80 includes two openings 81 located on a same plane. The two openings 81 are far away from each other. Two antenna structures 100 are disposed at the two openings 81 and are disposed opposite to each other. A distance L8 between the two antenna structures 100 is greater than 100 mm, for example, 420 mm, and a distance L9 between the antenna structure 100 and an edge of the second body 20*a* is, for example, 63.65 mm, but a distance relationship is not limited thereto.

Figure 10:
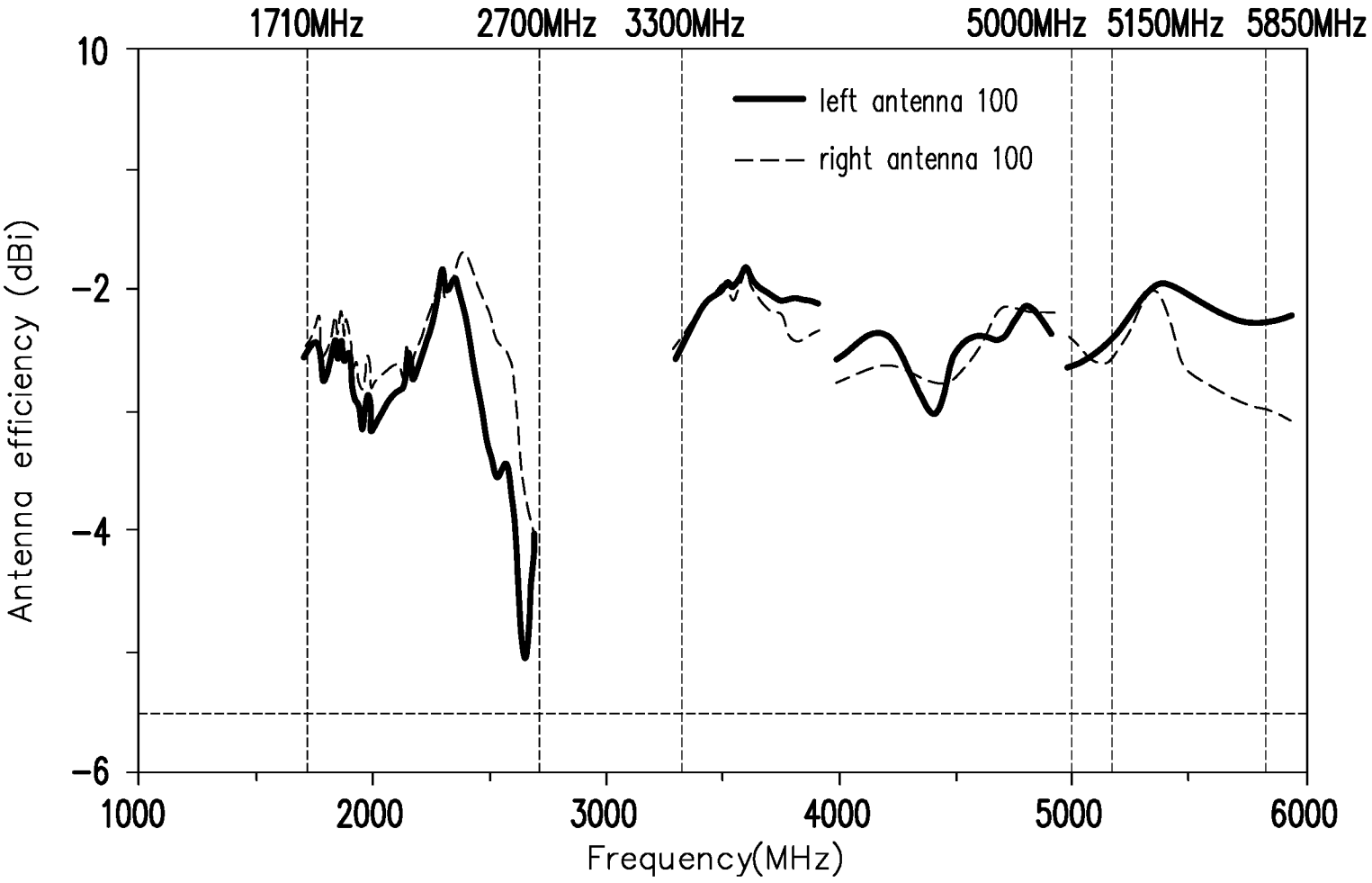
FIG. 10 is a relationship diagram of frequency-antenna efficiency of the electronic device in FIG. 8.

FIG. 10 is a relationship diagram of frequency-antenna efficiency of the electronic device in FIG. 8. Referring to FIG. 10, in the present embodiment, antenna efficiency performance of the two antenna structures 100 applied to the smart mirror device may be greater than −5.5 dBi, and has a good broadband performance.

To sum up, owing to the arrangement of the metal frame, the first radiator, the second radiator, the first conductor, and the second conductor of the antenna module provided in one or more embodiments of the disclosure, multiple frequency bands may be generated through coupling, so as to comply with broadband requirements.

Although the disclosure has been disclosed in the above embodiments, the embodiments are not intended to limit the disclosure. It will be apparent to persons skilled in the art that various modifications and variations can be made to the disclosed embodiments without departing from the scope or spirit of the disclosure. In view of the foregoing, it is intended that the disclosure cover modifications and variations provided that they fall within the scope of the following claims and their equivalents.

What is claimed is:

1. An antenna module, comprising:

a metal frame, having an opening and having a first edge and a second edge located at two opposite sides of the opening;

an antenna structure, disposed at the opening and comprising:

a first radiator, disposed at the opening and comprising a first section and a second section, wherein the first section is arranged near the first edge and comprises a feeding end, and the second section extends from the first section to the second edge;

a second radiator, disposed at the opening and located between the first section and the first edge, wherein a first slot is formed between the second radiator and the first section, and the second radiator comprises a ground end;

a first conductor, connected between the second radiator and the metal frame; and a second conductor, connected between the second section and the metal frame.

2. The antenna module according to claim 1, wherein the antenna structure further comprises a third radiator located in the opening, the metal frame further comprises a third edge between the first edge and the second edge, the third radiator is located among the second edge, the third edge, and the first section and the second section of the first radiator, and a second slot is formed among the third radiator, the second edge, and the third edge, and a shape of the second slot is an L-shape.

3. The antenna module according to claim 2, wherein the antenna structure further comprises a fourth radiator and a third conductor, the fourth radiator is located in the opening and extends from the first section to the second edge, a third slot is formed between the fourth radiator and the first section, and the third conductor is connected between the fourth radiator and the metal frame.

4. The antenna module according to claim 3, wherein the antenna structure further comprises a fifth radiator and a fourth conductor, the fifth radiator is located in the opening and extends from a side of the first section to the second edge, a fourth slot is formed between the fifth radiator and the first section, the fourth conductor is connected between the fifth radiator and the metal frame, and the fourth radiator is disposed in parallel to the fifth radiator.

5. The antenna module according to claim 1, further comprising an insulating member filling the opening, wherein the antenna structure is disposed on the insulating member.

6. The antenna module according to claim 1, further comprising another antenna structure, wherein the metal frame further comprises another opening and two opposite wall surfaces, the two openings are located on the two wall surfaces, and the two antenna structures are respectively disposed at the two openings.

7. The antenna module according to claim 6, further comprising at least one metal stopper wall disposed in the metal frame and located between the two antenna structures.

8. The antenna module according to claim 1, further comprising another antenna structure, wherein the metal frame further comprises another opening, the two openings are located on a same plane, a distance between the two openings is greater than 100 mm, and the two antenna structures are respectively disposed at the two openings.

9. The antenna module according to claim 1, wherein the metal frame comprises the first edge, a third edge, the second edge, and a fourth edge sequentially surrounding the opening, the first section comprises a first sub-region and a second sub-region connected to each other, the second section is connected at a junction between the first sub-region and the second sub-region, and the first sub-region, the second section, the second conductor, one part of the second edge, the third edge, one part of the first edge, the ground end, and the feeding end together constitute a first closed loop to generate a first frequency band and a second frequency band through coupling.

10. The antenna module according to claim 9, wherein the second sub-region, the second section, the second conductor, the other part of the second edge, the fourth edge, the other part of the first edge, the ground end, and the feeding end together constitute a second closed loop to generate the first frequency band, the second frequency band, and a third frequency band through coupling.

* * * * *